US011685597B2

(12) United States Patent
Kajiwara et al.

(10) Patent No.: US 11,685,597 B2
(45) Date of Patent: Jun. 27, 2023

(54) BAG MATERIAL AND CRUSHED STONE PLACEMENT METHOD USING BAG MATERIAL

(71) Applicants: KYOWA CO., LTD., Osaka (JP); SUMITOMO CORPORATION, Tokyo (JP)

(72) Inventors: Koji Kajiwara, Osaka (JP); Hironori Kawamura, Osaka (JP); Yoshihiro Ogawa, Osaka (JP); Shigeru Matsuo, Osaka (JP)

(73) Assignees: KYOWA CO., LTD., Osaka (JP); SUMITOMO CORPORATION, Tokyo (JP)

( * ) Notice: Subject to any disclaimer, the term of this patent is extended or adjusted under 35 U.S.C. 154(b) by 0 days.

(21) Appl. No.: 17/264,195

(22) PCT Filed: Jul. 31, 2018

(86) PCT No.: PCT/JP2018/028651
§ 371 (c)(1),
(2) Date: Jan. 28, 2021

(87) PCT Pub. No.: WO2020/026339
PCT Pub. Date: Feb. 6, 2020

(65) Prior Publication Data
US 2021/0309448 A1 Oct. 7, 2021

(51) Int. Cl.
*B65D 88/16* (2006.01)
*E02D 15/10* (2006.01)

(52) U.S. Cl.
CPC ..... *B65D 88/1668* (2013.01); *B65D 88/1618* (2013.01); *E02D 15/10* (2013.01)

(58) Field of Classification Search
CPC .. B65D 88/1618; B65D 88/1668; E02D 15/10
(Continued)

(56) References Cited

U.S. PATENT DOCUMENTS 3,547,079 A * 12/1970 Bassett ..... A01K 1/0254 383/41
4,194,652 A * 3/1980 Williamson ..... B65D 88/1612 112/475.08
(Continued)

FOREIGN PATENT DOCUMENTS

EP 2341592 A1 7/2011
JP S50-85539 U 7/1975
(Continued)

OTHER PUBLICATIONS

International Search Report issued in corresponding International Application No. PCT/JP2018/028651, dated Aug. 28, 2018, pp. 1-2, Japan Patent Office, Tokyo, Japan.
(Continued)

*Primary Examiner* — Peter N Helvey
(74) *Attorney, Agent, or Firm* — Hauptman Ham, LLP

(57) ABSTRACT

A bag material has a tubular shape and can be folded back at an intermediate position in a longitudinal direction. Crushed stones can be stored in a folded part of the back material. An opening on one side of the bag material can be moved to a position close to an opening on the other side of the bag material. A one-side closing rope that closes the opening on the one side of the bag material is provided near this opening. An other-side closing rope that closes the opening on the other side of the bag material is provided near this opening. The other of the one-side closing rope and the other-side closing ropes can be released with the opening closed by one closing rope.

20 Claims, 6 Drawing Sheets

(58) Field of Classification Search
USPC ..... 383/6
See application file for complete search history.

(56) References Cited

U.S. PATENT DOCUMENTS

| | | | | |
|---|---|---|---|---|
| 4,241,458 | A * | 12/1980 | Lesesne | A47G 9/068 2/69.5 |
| 4,979,833 | A * | 12/1990 | Cook | A45C 3/00 383/117 |
| 5,050,999 | A * | 9/1991 | Van Loon, III | A45C 3/045 383/76 |
| 5,150,970 | A * | 9/1992 | Albarelli | B65D 29/04 383/117 |
| 6,431,753 | B1 * | 8/2002 | Rogers | B65D 88/1668 383/41 |
| 6,520,825 | B1 * | 2/2003 | Herr | A63H 33/003 446/73 |
| 6,834,995 | B1 * | 12/2004 | Stevens | B65D 88/1668 383/41 |
| 2006/0018568 | A1 * | 1/2006 | Costello | B65F 1/00 383/4 |
| 2009/0046957 | A1 * | 2/2009 | Liang | B65D 33/004 156/499 |
| 2011/0252573 | A1 * | 10/2011 | Kingos | D06F 95/006 8/137 |
| 2012/0008878 | A1 * | 1/2012 | Saville | B65F 1/1468 493/210 |
| 2012/0328217 | A1 * | 12/2012 | Sale | B65D 31/04 383/7 |
| 2013/0136381 | A1 * | 5/2013 | Waldorf | A45C 13/1046 383/6 |
| 2019/0300278 | A1 * | 10/2019 | Abed | B65D 33/28 |

FOREIGN PATENT DOCUMENTS

| | | | |
|---|---|---|---|
| JP | H04-060893 | U | 5/1992 |
| JP | H0524043 | A | 2/1993 |
| JP | 2001064933 | A | 3/2001 |
| JP | 2009024400 | A | 2/2009 |
| JP | 2012131532 | A | 7/2012 |
| JP | 2016033022 | A | 3/2016 |
| JP | 2017149446 | A | 8/2017 |
| KR | 20120007722 | U | 11/2012 |

OTHER PUBLICATIONS

Extended European Search Report issued in corresponding European Application No. 18928365.8, dated Nov. 9, 2021, pp. 1-7, European Patent Office, Munich, Germany.

* cited by examiner

BAG MATERIAL AND CRUSHED STONE PLACEMENT METHOD USING BAG MATERIAL

CROSS-REFERENCE TO RELATED APPLICATIONS

The present application is a National Phase of International Application Number PCT/JP2018/028651, filed Jul. 31, 2018, which is hereby incorporated by reference in its entirety.

TECHNICAL FIELD

The present invention relates to bag materials and crushed stone placement methods using the bag material, and more particularly to a bag material that allows easy placement of crushed stones at a desired position and a crushed stone placement method using the bag material.

BACKGROUND ART

Conventionally, in rivers, harbors, etc., recesses are sometimes formed in the bottoms of rivers and the bottoms of bays due to scouring etc. When placing crushed stones to build a breakwater etc., net bags containing crushed stones etc. are deposited. For example, Japanese Unexamined Patent Publication No. 2009-24400 (Patent Literature 1) describes a technique for placing crushed stones using a grabbucket attached to a crane in such a case.

CITATION LIST

Patent Literatures

Patent Literature 1: Japanese Unexamined Patent Publication No. 2009-24400 (Abstract)

SUMMARY OF INVENTION

Technical Problem

Conventionally, crushed stones etc. are placed into recesses formed in rivers, harbors, etc. by such a method as described above. The method for placing crushed stones using a grabbucket attached to a crane is commonly used because of its easiness.

In this case, however, when the water is deep, the grabbucket does not reach the bottom, and crushed stones are scattered. It is therefore not easy to reliably place the crushed stones to a desired position.

The present invention was made to solve the above problem, and it is an object of the present invention to provide a bag material for placement of crushed stones that allows easy placement of crushed stones and a crushed stone placement method using the bag material.

Solution to Problem

A bag material according to the present invention is a bag material that has a tubular shape and that can be folded back at an intermediate position in a longitudinal direction. Crushed stones can be stored in a folded part of the back material, and an opening on one side of the bag material can be moved to a position close to an opening on the other side of the bag material. The bag material includes: a one-side closing rope that is provided near the opening on the one side of the bag material and that closes the opening on the one side of the bag material; and an other-side closing rope that is provided near the opening on the other side of the bag material and that closes the opening on the other side of the bag material. The other of the one-side and other-side closing ropes can be released with the opening closed by one closing rope.

Preferably, the entire bag material has mesh holes.

More preferably, the one-side closing rope is passed through the mesh holes near the opening on the one side of the bag material, the other-side closing rope is passed through the mesh holes near the opening on the other side of the bag material, and the one-side closing rope and the other-side closing rope operate as lifting ropes that lift the bag material.

Another aspect of the present invention is a method for placing crushed stones using a bag material. The method includes: folding back the bag material having a tubular shape at an intermediate position in a longitudinal direction; storing the crushed stones in a folded part of the bag material; closing openings on one side and the other side of the bag material by closing ropes; and pulling up both of the closing ropes together with a hook and releasing at a desired position only the closing rope that closes one of the openings of the bag material.

Advantageous Effects of Invention

In the bag material according to the present invention, the crushed stones can be stored in the folded part of the tubular bag material, and the opening on the one side of the bag material can be moved to a position close to the opening on the other side of the bag material. The closing rope that closes the opening on the one side of the bag material is provided near the opening on the one side of the bag material, the closing rope that closes the opening on the other side of the bag material is provided near the opening on the other side of the bag material. The other of the closing ropes can be released with the opening closed by one closing rope.

Since the crushed stones are stored in the bag material and the other of the closing ropes is released with the opening closed by one closing rope, the bag material returns to its original tubular shape and the crushed stones in the bag material fall.

In the method for placing crushed stones according to the present invention, the crushed stones are stored in the folded part of the bag material having the above structure, and the openings on the one side and the other side of the bag material are closed by the closing ropes. Both of the closing ropes are pulled up together with the hook, and only the other of the closing ropes is released with the opening closed by one closing rope. Due to the weight of the crushed stones stored in the folded part of the bag material, the crushed stones fall out of the bag material and the bag material is deployed straight downward and returns to its original tubular shape.

The present invention thus provides a bag material for placement of crushed stones that allows easy placement of crushed stones and a crushed stone placement method using the bag material.

DESCRIPTION OF EMBODIMENTS

Figure 1:
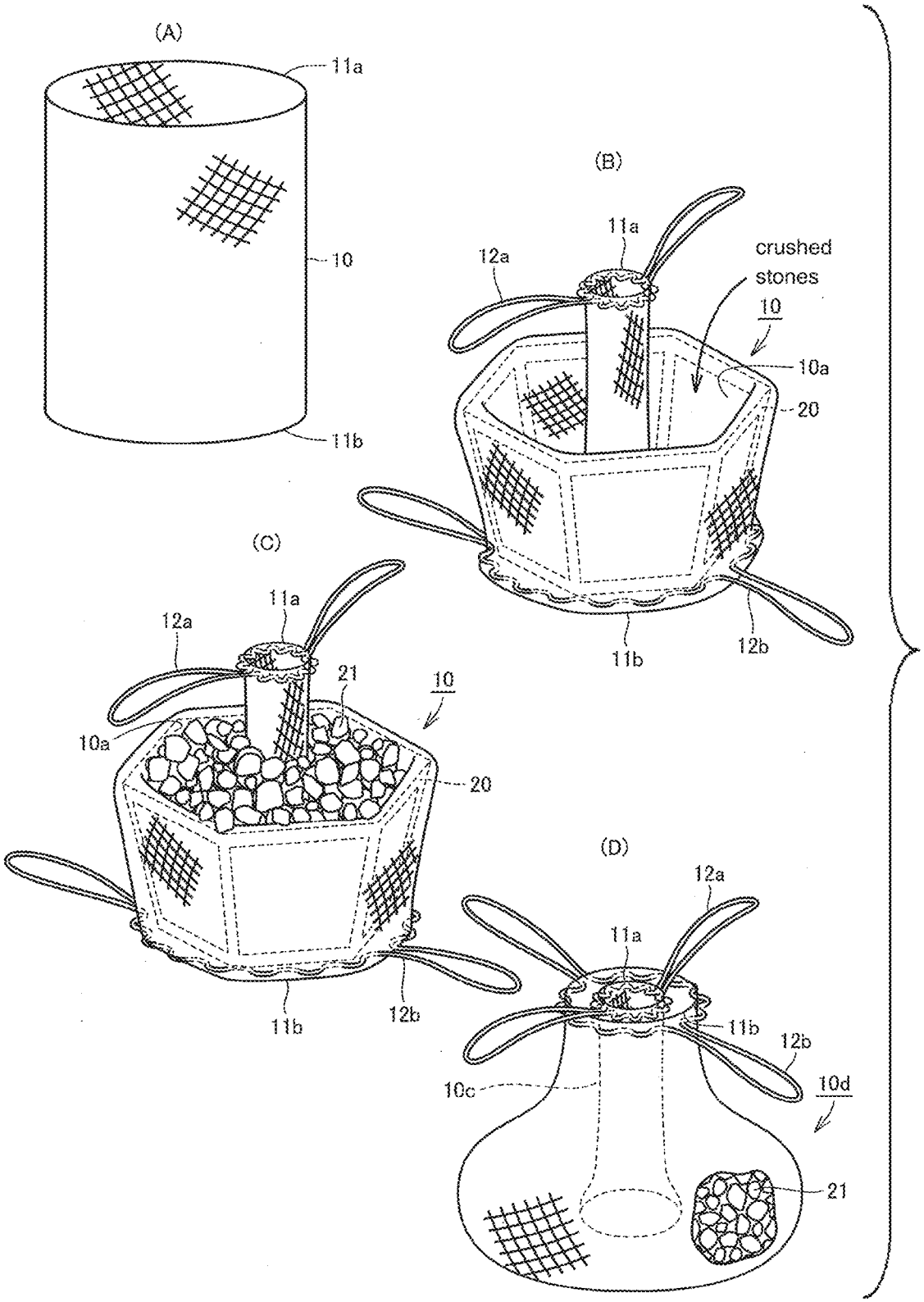
FIG. 1 illustrates a method of manufacturing a bag using a bag material according to an embodiment of the present invention.

An embodiment of the present invention will be described with reference to the drawings. FIG. 1 illustrates, step by step, a process of manufacturing a bag containing crushed stones by using a bag material according to the embodiment of the present invention. First, a tubular bag material 10 is prepared (FIG. 1(A)). The bag material 10 has an upper opening 11*a* and a lower opening 11*b*.

The bag material 10 is a material knitted with synthetic fibers and is preferably a raschel knit mesh having mesh holes. The bag material 10 is preferably a mesh knotted net, a knotless net (twisted knotless net, raschel net), or a moji net, and a raschel net that does not easily get loose is particularly preferred.

Next, a crushed stone packing base 20 is prepared. The crushed stone packing base 20 is a steel frame in the shape of an inverted truncated substantially regular hexagonal pyramid. With the upper opening 11*a* of the bag material 10 closed and held at a predetermined position, the lower part of the bag material 10 is opened and placed over the crushed stone packing base 20 so as to cover the crushed stone packing base 20. The cylindrical lower part of the bag material 10 is first spread over a hexagonal bottom surface, not shown, of the crushed stone packing base 20 and is then placed along the inner side surface of the crushed stone packing base 20 so as to cover the upper end of the crushed stone packing base 20 and to hang down along the outer surface of the crushed stone packing base 20. FIG. 1(B) illustrates the bag material 10 in this state. As shown in the figure, the lower opening 11*b* of the bag material 10 is located on the hexagonal outer periphery of the crushed stone packing base 20. A hook etc. that holds the upper opening 11*a* at the predetermined position is not shown in the figures.

Closing ropes 12*a*, 12*b* for closing the openings 11*a*, 11*b* are provided near the upper and lower openings 11*a*, 11*b* of the bag material 10, respectively. In the figures, two loops of the closing rope 12*a* and two loops of the closing rope 12*b* are shown pulled out of the upper and lower openings 11*a*, 11*b* at symmetrical positions for hanging.

Crushed stones 21 are then placed into a folded part 10*a* of the bag material 10. FIG. 1(C) illustrates the bag material 10 with the crushed stones 21 placed in the folded part 10*a*. The loops of the closing rope 12*b* for closing the lower opening 11*b* located near the bottom of the crushed stone packing base 20 are then pulled up to substantially the same position as the closing rope 12*a* for closing the upper opening 11*a*.

FIG. 1(D) illustrates the appearance of the resultant bag material 10. As shown in FIG. 1(D), the bag material 10 is in the shape of a triangular pyramid with a cylindrical tube 10*c* in the middle. The crushed stones 21 are held in a doughnut shape in the bag material 10. The bag material containing crushed stones in this manner is herein referred to as the bag 10*d*.

The crushed stone includes not only common crushed stone but also rubble, soil and sand, etc.

At this time, a part of the closing rope 12*a* for the inner opening 11*a* and a part of the closing rope 12*b* for the outer opening 11*b* are pulled outward as shown in FIG. 1(D) so that these parts are used as hanging ropes for hanging the bag material 10.

Next, the closing ropes 12*a*, 12*b* that are provided near the openings 11*a*, 11*b* of the bag material 10 and that are used to close the openings 11*a*, 11*b* of the bag material 10 will be described.

Figure 2:
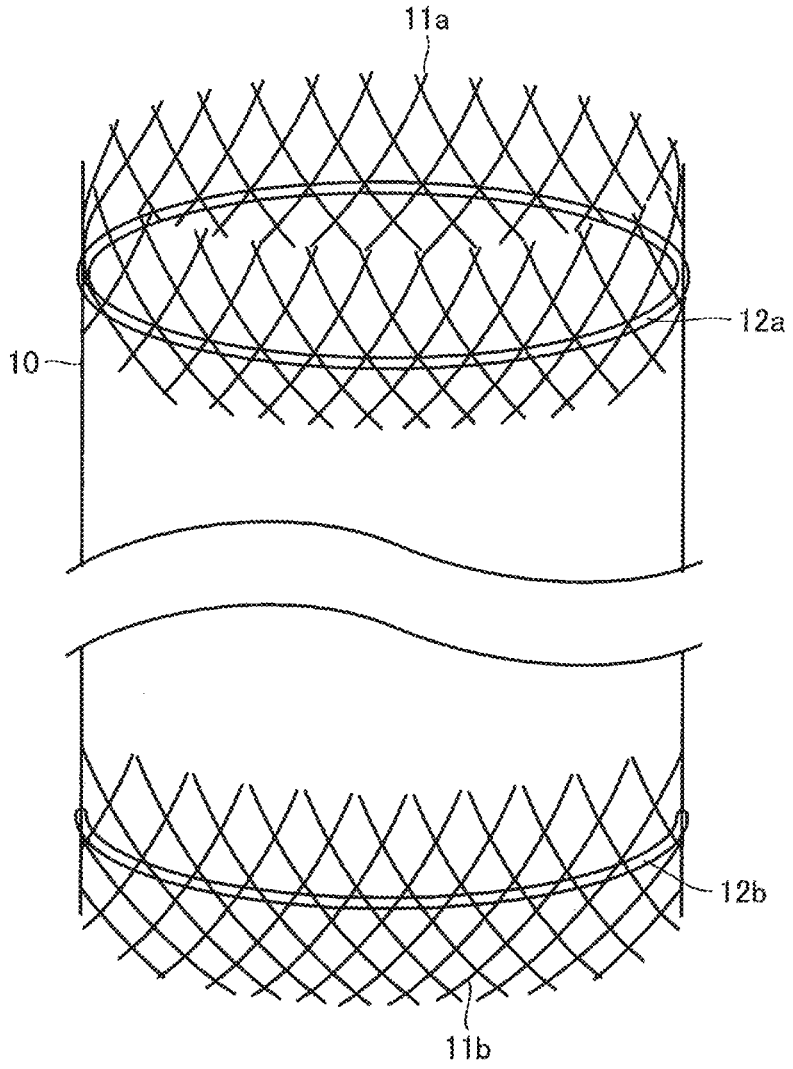
FIG. 2 illustrates details of openings of the bag material.

FIG. 2 is an enlarged view of the portions around the upper and lower openings 11*a*, 11*b* of the tubular bag material 10 shown in FIG. 1(A). Referring to FIG. 2, the bag material 10 has mesh holes. The upper closing rope 12*a* is passed through the upper end of the bag material 10 near the opening 11*a* (the mesh holes in any of the second to fifth rows from the top) so as to run through the mesh holes along the entire opening 11*a*. The lower closing rope 12*b* is passed through the lower end of the bag material 10 near the opening 11*b* (the mesh holes in any of the second to fifth rows from the bottom) so as to run through the mesh holes along the entire opening 11*b*.

Figure 3:
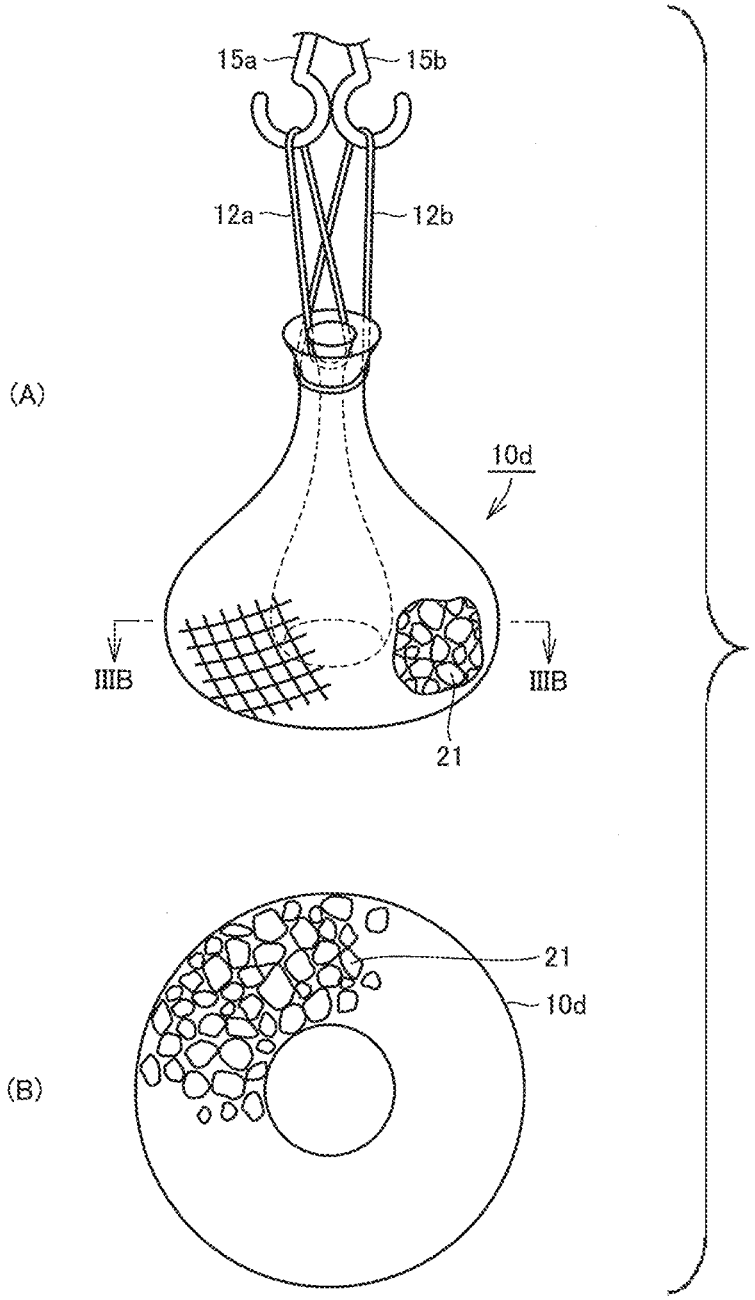
FIG. 3 illustrates a lifted bag made of the bag material.

Next, a method for lifting the bag 10*d* with the crushed stones placed therein will be described. FIG. 3 illustrates this method. FIG. 3(A) is a perspective view, and FIG. 3(B) is a sectional view taken along arrow line IIIB-IIIB in FIG. 3(A). Referring to FIG. 3(A), the bag 10*d* is hung on and lifted by, e.g., crane hooks 15*a*, 15*b* using the two closing ropes, namely the upper closing rope 12*a* and the lower closing rope 12*b*. The upper and lower closing ropes 12*a*, 12*b* thus operate as lifting ropes.

At this time, the upper closing rope 12*a* for the upper opening located on the inner side of the bag 10*d* and the lower closing rope 12*b* for the lower opening located on the outer side of the bag 10*d* are separately pulled up by the hook 15*a* and the hook 15*b*, respectively. In the figure, the hooks are illustrated so as to clearly show that separate hooks are used.

FIG. 3B illustrates the bag 10*d* taken along and viewed in the direction of arrows IIIB-IIIB in FIG. 3A. As shown in FIG. 3B, the crushed stones are held in a doughnut shape in the bag 10*d*.

Next, a method for placing the crushed stones 21 held in the bag 10*d* to a desired position will be described. FIGS. 4(A) to 4(C) illustrate this method step by step.

FIG. 4(A) illustrates the state shown in FIG. 3(A). The crushed stones 21 are held in the bag 10*d*. In this state, the bag 10*d* is moved to a desired position by the hooks 15*a*, 15*b*.

The hook 15*a* is then removed from the upper closing rope 12*a* located on the inner side while holding the hook 15*b* at the same position with the lower closing rope 12*b*, which is located on the outer side, hanging from the hook 15*b*.

FIG. 4(B) illustrates this state. Since the upper closing rope 12*a* located on the inner side is released, the upper opening 11*a* is opened, so that the crushed stones 21 are surrounded by the bag 10*d* connected to the lower closing rope 12*b* located on the outer side. The crushed stones 21 thus fall to the ground by their weight.

FIG. 4(C) illustrates the state after all the crushed stones 21 fall on the ground. As shown in the figure, the crushed stones 21 fall so as to form a mountain shape.

The above embodiment illustrates the case where the upper closing rope 12*a* is released while holding the lower closing rope 12*b*. However, the invention is not limited to this, and the lower closing rope 12*b* may be released while holding the upper closing rope 12*a*. This procedure is illustrated in FIG. 5. FIGS. 5(A) to 5(C) correspond to FIGS. 4(A) to 4(C), respectively.

In this case, the hook 15*b* is removed from the lower closing rope 12*b* located on the outer side while holding the hook 15*a* at the same position with the upper closing rope 12*a*, which is located on the inner side, hanging from the hook 15*a*.

FIG. 5(B) illustrates this state. Since the lower closing rope 12*b* is released, the lower opening 11*b* is opened, so that the crushed stones 21 are guided by the inner surface of the bag 10*d* connected to the upper closing rope 12*a* located on the inner side. The crushed stones 21 thus fall to the ground by their weight so as to be deposited around the bag.

Figure 4:
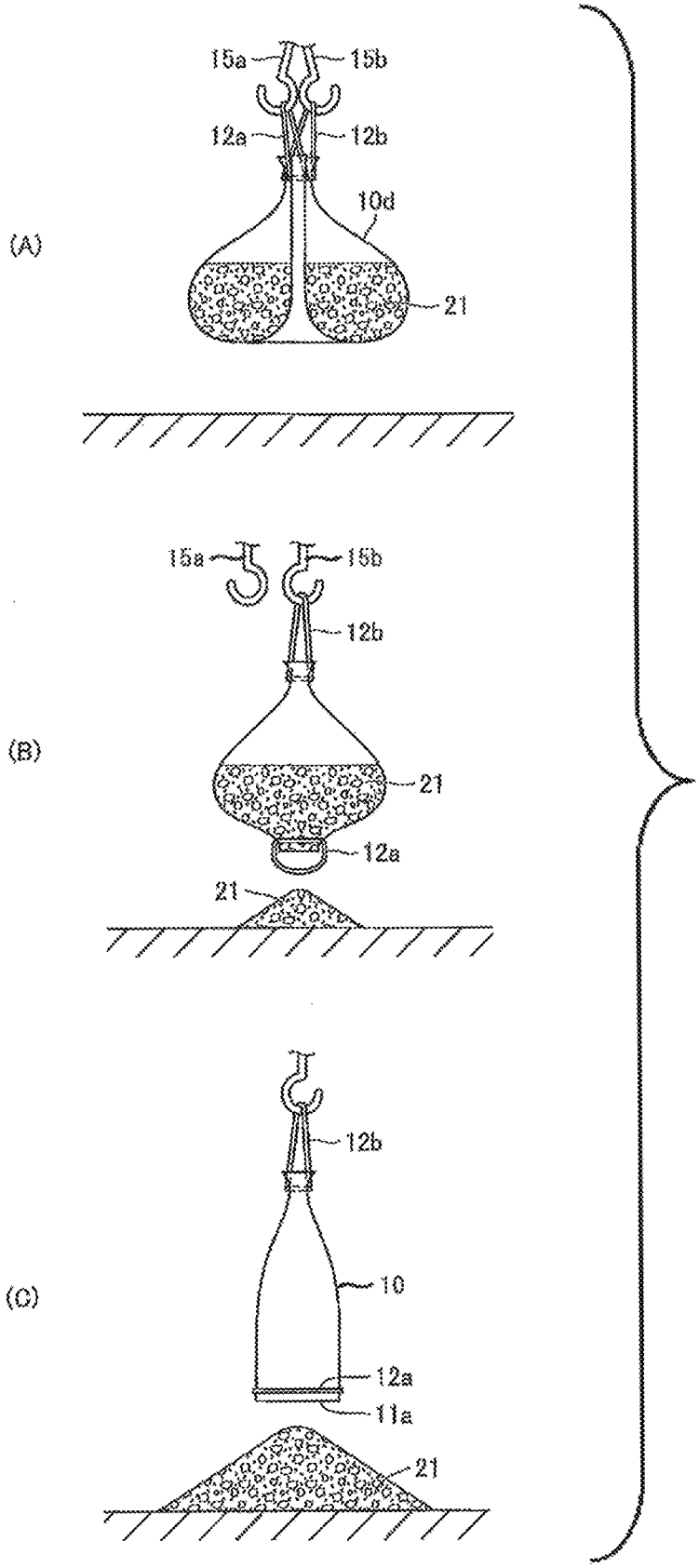
FIG. 4 illustrates a procedure of lifting a bag made of the bag material and placing crushed stones.
Figure 5:
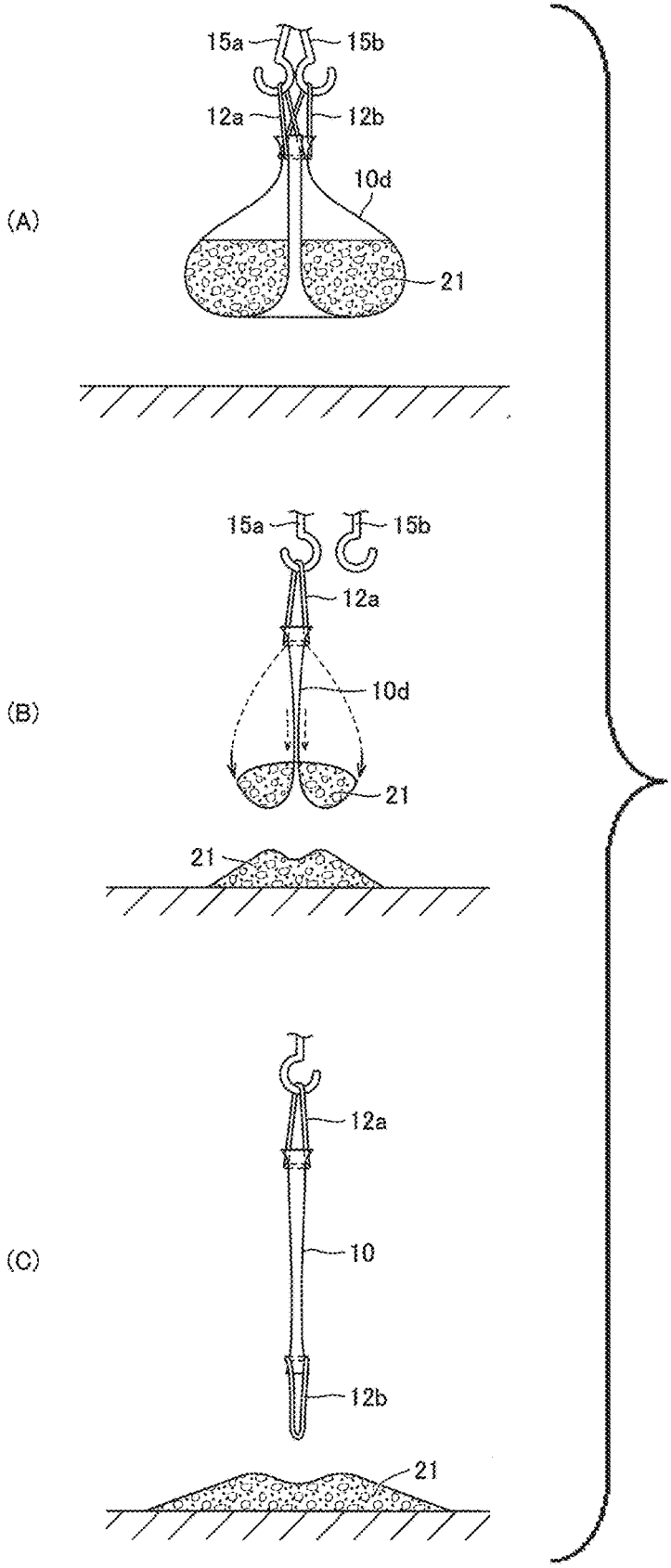
FIG. 5 illustrates another procedure of lifting a bag made of the bag material and placing crushed stones.

In this case, as opposed to the case shown in FIG. 4, the crushed stones can be placed at a desired position such that a recess is formed in the center of the pile of the crushed stones. This procedure is preferable because the crushed stones can be placed in the shape of a crater when fixing uneven recesses or laying cables or pipelines.

Next, other embodiments of the present invention will be described. The above embodiment illustrates the case where the positions of the upper and lower openings are substantially the same. However, the positions of the upper and lower openings may be different.

Figure 6:
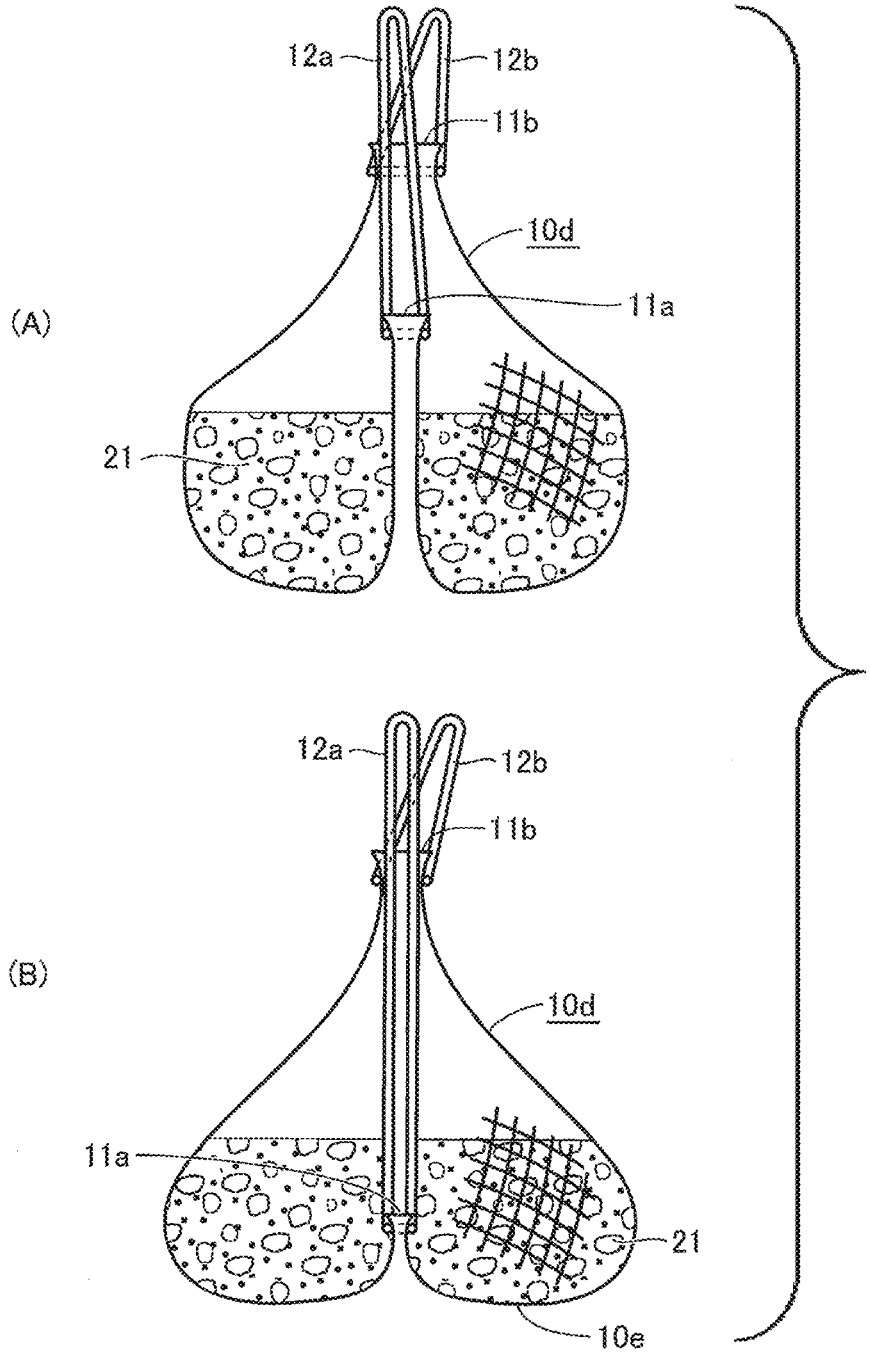
FIG. 6 illustrates the positions of closing ropes for both openings of a bag is made of the bag material.

FIGS. 6(A) and 6(B) illustrate other embodiments of the present invention in which the positions of the upper and lower openings are different. In FIG. 6A, the upper opening 11*a* is located below the lower opening 11*b* and above the position where the crushed stones 21 are stored. In this case as well, the hanging positions of the closing ropes 12*a*, 12*b* are substantially the same.

Even with this configuration, the crushed stones 21 will not drop from the bag 10*d*, and an operation similar to that of the above embodiment can be performed.

In FIG. 6(B), the hanging position of the upper opening 11*a* is located below the hanging position of the lower opening 11*b* and is located at the position where the crushed stones 21 are stored. It is to be understood that, in this case as well, the upper opening 11*a* need be located above a bottom 10*e* of the bag 10*d*.

Even with this configuration, the crushed stones 21 try to gather at the center when the bag 10*d* is lifted. The crushed stones 21 therefore will not drop from the bag material 10 due to interaction of the crushed stones, and an operation similar to that of the above embodiment can be performed.

The positions of the lower opening 11*b* and the upper opening 11*a* may be reversed.

As described above, in the embodiments, the tubular bag material is folded back to form a crushed stone storing portion, and the upper and lower openings of the bag containing the crushed stones are closed by the closing ropes. Both of the closing ropes are pulled up together with the hooks, and only the closing rope closing the opening on the inner side of the bag is released at a desired position. Due to the weight of the crushed stones stored between the inner and outer sides of the bag, the crushed stones fall out of the bag and the opening on the inner side of the bag is deployed straight downward, whereby the bag returns to its original tubular bag material.

The crushed stones can thus be placed at a desired position.

Next, effects of the present invention will be specifically described based on examples and comparative examples. In the examples, crushed stones (dimensions: 200 mm to 300 mm) were placed onto the bottom of a sea using a bag made of the bag material according to the present invention. In the comparative examples, crushed stones were placed using the grabbucket attached to the crane described in the background art.

Whether crushed stones can be accurately placed (dumped) in an intended range was checked by civil engineering experiments for the case where crushed stones were placed using a bag and the case where crushed stones were placed using a grabbucket. The conditions for each case are as follows.

Example 1

Crushed stones were dumped by the method of the present invention using a bag for 2 tons.

Example 2

Crushed stones were dumped by the method of the present invention using a bag for 4 tons.

Example 3

Crushed stones were dumped by the method of the present invention using a bag for 8 tons.

Comparative Example 1

2 tons of crushed stones were dumped using a grabbucket.

Comparative Example 2

4 tons of crushed stones were dumped using a grabbucket.

Comparative Example 3

8 tons of crushed stones were dumped using a grabbucket.

The results are shown in Table 1. The data in Table 1 shows the case where crushed stones were dumped on the ground.

TABLE 1

| Items | Example 1 | Example 2 | Example 3 | Comparative Example 1 | Comparative Example 2 | Comparative Example 3 |
|---|---|---|---|---|---|---|
| Weight of Crushed Stones (t) | 2 | 4 | 8 | 2 | 4 | 8 |
| Diameter of Lifted Bag Material (m) | 1.6 | 1.8 | 2.0 | — | — | — |
| Dumped Crushed Stones Diameter (m) | 1.7 | 1.9 | 2.1 | 2.5 | 2.8 | 3.5 |
| Height (m) | 0.4 | 0.5 | 0.7 | 0.3 | 0.35 | 0.5 |

Figure 7:
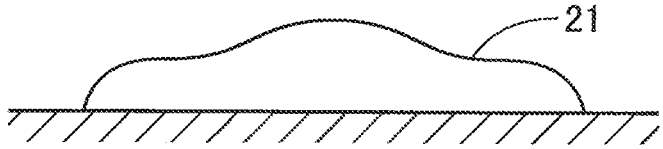
FIG. 7 illustrates crushed stones placed on the bottom of a sea.

Next, how the dumped crushed stones were deposited will be described. First, examples in which crushed stones were dumped on the ground will be described. In Examples 1 to 3, the dumped crushed stones were piled with the angle of repose. FIG. 7 illustrates the crushed stones dumped using the grabbucket. Referring to FIG. 7, the crushed stones dumped using the grabbucket are piled flat rather than with the angle of repose.

Next, examples in which crushed stones were deposited in water will be described. In Examples 1 to 3, the dumped crushed stones were piled with an angle close to the angle of repose. However, since the dumped crushed stones were in water, the weight of the crushed stones was reduced to about 1/10 and the height of the pile was slightly reduced. On the other hand, the crushed stones dumped using the grabbucket were piled basically in a manner similar to FIG. 7, but the diameter of the pile was increased to about 1.5 times and the height of the pile was about 70%.

The above embodiments illustrate the case where the entire cylindrical bag material has mesh holes. However, the present invention is not limited to this, and the bag material may be cloth. In this case, through holes for passing the closing ropes therethrough are formed near both ends of the cloth. Moreover, in this case, ready-mix concrete, soil and sand, gravel, etc. can be stored in the bag for placement.

Although the embodiments of the present invention are described above with reference to the drawings, the present invention is a method that allows crushed stones to be placed on the right spot on the bottom of a river or the bottom of a sea without scattering, and is not limited to the illustrated embodiments. Various modifications can be made to the illustrated embodiments without departing from the spirit and scope of the present invention.

INDUSTRIAL APPLICABILITY

Since the present invention provides a bag material that allows easy placement of crushed stones, the present invention is advantageously used as a bag material for placement of crushed stones.

REFERENCE SIGNS LIST

10 Bag Material
10*a* Folded Part
10*c* Tube
10*d* Bag
11*a*, 11*b* Opening
12*a*, 12*b* Closing Rope
15 Hook
20 Crushed Stone Packing Base
21 Crushed Stone

The invention claimed is:

1. A bag material that has a tubular shape and that can be folded back at an intermediate position in a longitudinal direction, wherein crushed stones can be stored in a folded part of the bag material, and an opening on one side of the bag material can be moved to a position close to an opening on the other side of the bag material, the bag material comprising:

a one-side closing rope that is provided near the opening on the one side of the bag material and that closes the opening on the one side of the bag material; and an other-side closing rope that is provided near the opening on the other side of the bag material and that closes the opening on the other side of the bag material, wherein the one-side closing rope and the other-side closing rope are configured to operate as lifting ropes that support the weight of the bag material and the crushed stones, and one of the one-side and other-side closing ropes can be released with the opening closed by the other of the one-side and the other-side closing ropes remaining closed.

2. The bag material according to claim 1, wherein the entire bag material has mesh holes.

3. The bag material according to claim 2, wherein the one-side closing rope is passed through the mesh holes near the opening on the one side of the bag material, and the other-side closing rope is passed through the mesh holes near the opening on the other side of the bag material.

4. The bag material according to claim 1, wherein the opening on the one side of the bag material and the opening on the other side of the bag material are equal in size when in a fully open state.

5. The bag material according to claim 1, wherein the one-side closing rope and the other-side closing rope are configured to, when pulled upward so as to lift the bag material, cause the opening on the one side and the opening on the other side to close, the release of the one-side closing rope causes the opening on the one side of the bag material to open, and the release of the other-side closing rope causes the opening on the other side of the bag material to open.

6. The bag material according to claim 1, wherein the one-side closing rope and the other-side closing rope are configured to support a weight of at least two tons.

7. A bag material that has a cylindrical shape and that can be folded back at an intermediate position in a longitudinal direction, wherein crushed stones can be stored in a folded part of the bag material, and an opening on one side of the bag material can be moved to a position close to an opening on the other side of the bag material, the bag material comprising:

a one-side closing rope that is provided near the opening on the one side of the bag material and that closes the opening on the one side of the bag material; and an other-side closing rope that is provided near the opening on the other side of the bag material and that closes the opening on the other side of the bag material, wherein the one-side closing rope and the other-side closing rope are configured to operate as lifting ropes that, when engaged by at least one hook to lift the bag material, cause the opening on the one side and the opening on the other side to close, and a release of one of the one-side closing rope or the other-side closing rope causes the opening on the one side of the bag material or the opening on the other side of the bag material to open.

8. The bag material according to claim 7, wherein the one-side closing rope and the other-side closing rope are configured to support a weight of at least two tons.

9. The bag material according to claim 7, wherein the entire bag material has mesh holes.

10. The bag material according to claim 9, wherein the one-side closing rope is passed through the mesh holes on the one side of the bag material, and the other-side closing rope is passed through the mesh holes on the other side of the bag material.

11. A crushed stone placement bag, comprising:

a unitary bag material having a first end and a second end opposite the first end, the unitary bag material being tubular with a first opening at the first end and a second opening at the second end;

a first rope at the first end of the unitary bag material; and a second rope at the second end of the unitary bag material;

wherein in a state in which an intermediate portion of the unitary bag material between the first end and the second end is folded back toward one of the first end or the second end, a pocket is formed within a folded back portion of the unitary bag material, the unitary bag material is configured to accommodate crushed stones in the pocket within the folded back portion of the unitary bag material, the first rope and the second rope are configured to operate as lifting ropes that, when engaged to lift the unitary bag material with crushed stones in the pocket within the folded back portion of the unitary bag material, cause the first opening on the first end and the second opening on the second end to close, and releasing one of the first rope or the second rope causes the first opening on the first end of the unitary bag material or the second opening on the second end of the unitary bag material to open with the other of the first rope or the second rope remaining engaged such that the other of the first opening or the second opening remains closed so as to release the crushed stones from the pocket within the folded back portion of the unitary bag material.

12. The crushed stone placement bag according to claim 11, wherein the first rope and the second rope are configured to support a weight of at least two tons.

13. The crushed stone placement bag according to claim 12, wherein the first rope and the second rope are loops that are configured to be lifted by at least one hook.

14. The crushed stone placement bag according to claim 11, wherein the entire unitary bag material has mesh holes.

15. The crushed stone placement bag according to claim 14, wherein the first rope is passed through the mesh holes near the first opening on the first end of the unitary bag material, and the second rope is passed through the mesh holes near the second opening on the second end of the unitary bag material.

16. The crushed stone placement bag according to claim 11, wherein the unitary bag material is cylindrical.

17. The crushed stone placement bag according to claim 11, wherein the first opening and the second opening are equal sizes.

18. The crushed stone placement bag according to claim 11, wherein in the state in which the intermediate portion of the unitary bag material between the first end and the second end is folded back toward the one of the first end or the second end, one of the first rope or the second rope is drawn such that one of first opening or the second opening is smaller than the other of the first opening or the second opening.

19. The crushed stone placement bag according to claim 11, wherein when the first rope and the second rope are engaged to lift the unitary bag material with crushed stones in the pocket within the folded back portion of the unitary bag material, the pocket of the folded back portion of the unitary bag material is donut-shaped in cross-section.

20. The crushed stone placement bag according to claim 11, wherein when the first rope and the second rope cause the first opening and the second opening to be in a closed state, the first rope surrounds the second rope, the second rope surrounds the first rope, the first rope surrounds the second end of the unitary bag material, or the second rope surrounds the first end of the unitary bag material.

* * * * *